US006655388B2

(12) United States Patent
Stevenson

(10) Patent No.: US 6,655,388 B2
(45) Date of Patent: Dec. 2, 2003

(54) COSMETIC DEVICE AND METHOD

(76) Inventor: Rachel Stevenson, 3419 Motor Ave., #1, Los Angeles, CA (US) 90034

( * ) Notice: Subject to any disclaimer, the term of this patent is extended or adjusted under 35 U.S.C. 154(b) by 0 days.

(21) Appl. No.: 10/062,789

(22) Filed: Feb. 1, 2002

(65) Prior Publication Data

US 2002/0104547 A1 Aug. 8, 2002

Related U.S. Application Data

(60) Provisional application No. 60/266,517, filed on Feb. 5, 2001.

(51) Int. Cl.[7] ..... A61K 7/135
(52) U.S. Cl. ..... 132/208
(58) Field of Search ..... 132/208, 212, 132/112, 115, 108; 222/145, 145.1, 219, 129, 130

(56) References Cited

U.S. PATENT DOCUMENTS 3,964,643 A * 6/1976 Morane et al. ..... 222/145
5,076,298 A * 12/1991 Busch et al. ..... 132/109
5,439,137 A * 8/1995 Grollier et al. ..... 222/1
5,582,327 A * 12/1996 De Laforcade ..... 222/1
5,613,623 A * 3/1997 Hildebrandt ..... 222/129
5,848,732 A * 12/1998 Brugger ..... 222/137
2001/0050089 A1 12/2001 Fitjer ..... 132/218
2001/0052348 A1 12/2001 Fischer et al. ..... 132/218
2002/0001500 A1 1/2002 Dumler ..... 401/194

OTHER PUBLICATIONS

Copy of product insert or Revlon Professional Roux Lash & Brow Tint.
Instructions for E–Z Permanent Makeup™ Eyelash and Brow Tinting.

* cited by examiner

*Primary Examiner*—John J. Wilson
*Assistant Examiner*—Robyn Kieu Doan

(57) ABSTRACT

A cosmetic device comprises an enclosure that contains a liquid color composition and a liquid catalyst composition. The enclosure also comprises a seal that prevents the liquids from mixing when such mixing is not desired, and allows them to be intermixed to form a color altering composition when such mixing is desired. In a preferred embodiment, the seal is a perforatable seal. Methods of using the device involve applying the color altering composition to the skin or hair with an applicator.

11 Claims, 3 Drawing Sheets

Figure 1
Fig. 1A
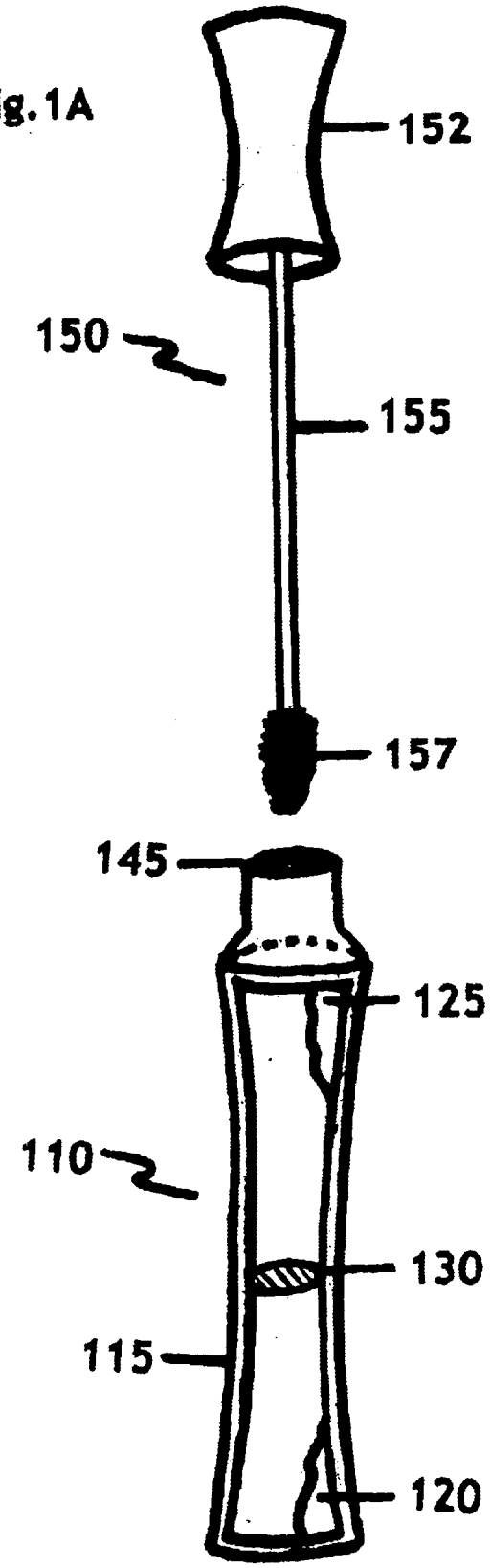
Fig. 1B
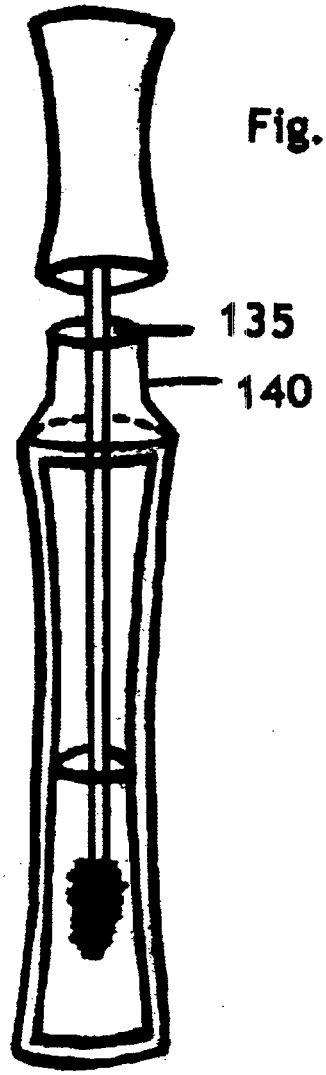

330
300

340
350

327
335
312
325
314
320
355

COSMETIC DEVICE AND METHOD

RELATED APPLICATION INFORMATION

This application claims priority to U.S. Provisional Application Serial No. 60/266,517, filed Feb. 5, 2001, which is hereby incorporated by reference in its entirety.

BACKGROUND OF THE INVENTION

1. Field of the Invention

This invention generally relates to cosmetic devices and methods for using them, and more particularly to cosmetic devices and methods useful for altering the color of skin or hair.

2. Description of the Related Art

A variety of products are commercially available for altering the color of the eyelashes and/or eyebrows. In many cases it is desirable for the altered color to persist for days or weeks, and a number of the commercially available products provide this capability. Examples of such products are Roux Lash and Brow Tint kit, available from Revlon; Reflectocil, available from Austria; and Lash and Brow Tint kit, available from E-Z Permanent Makeup. These products typically consist of two or more cremes or solutions (e.g., the "color" and "catalyst") that are mixed together immediately prior to use to form a tinting composition, which is then applied to the eyelashes or eyebrows. Because of a chemical reaction that apparently occurs between the individual components, the resulting mixture generally has a limited shelf life, and therefore is not generally sold in a pre-mixed form.

The overall process of mixing and applying tends to be relatively messy and time-consuming because the components are typically supplied in separate containers, then mixed together in a third container just prior to application. Many of these products irritate the eyes, so they are generally sold to professional cosmetologists for application in salons. The salon application process typically takes at least about 30 minutes, and the costs to the user are relatively high.

Thus, there is a need for a more user-friendly product that can be used to alter the color of hair or skin, and especially the eyebrows and/or eyelashes, for a period of at least about 4 weeks.

SUMMARY OF THE INVENTION

This invention is directed to devices and methods of using them that provide numerous benefits to the user. In a preferred embodiment, a device for altering the color of hair or skin is provided, comprising: (a) an enclosure comprising an opening and a liquid storage reservoir, wherein the liquid storage reservoir contains a liquid color composition and a liquid catalyst composition; and (b) a seal positioned between the liquid color composition and the liquid catalyst composition, the seal being adapted to prevent mixing of the liquid color composition and the liquid catalyst composition when such mixing is not desired, and to allow mixing between the liquid color composition and the liquid catalyst composition to form a color altering composition when such mixing is desired, wherein the color altering composition is suitable for altering the color of hair or skin. Preferably, the device further comprises a cap sealingly attached to the opening. Preferably, the enclosure is clear or translucent. Preferably, the liquid color composition is a cream and wherein the liquid catalyst composition is a cream.

Preferably, with regard to the preferred devices described above, the seal is a perforatable seal attached to the enclosure and positioned between the liquid color composition and the liquid catalyst composition so as to prevent mixing when the perforatable seal is not perforated and to allow mixing to form the color altering composition when the perforatable seal is perforated. Preferably, the device further comprises a second perforatable seal positioned to prevent the liquid color composition and the liquid catalyst composition from passing through the opening. Preferably, the perforatable seal comprises one or more layers, the one or more layers comprising a material selected from the group consisting of plastic, metal, and paper. Preferably, the device further comprises an applicator suitable for applying the color altering composition to the hair or skin, and sized to allow at least a portion of the applicator to pass through the opening. Preferably, the applicator comprises a wand and a brush, and is suitable for perforating the perforatable seal. Preferably, the color altering composition comprises a plant extract and is suitable for altering the color of eyelashes or eyebrows, and preferably the applicator is suitable for applying the color altering composition to the eyelashes or eyebrows. Preferably, the color altering composition is suitable for altering the color of the eyelashes or eyebrows for a period of at least about 4 weeks. Preferably, the enclosure is obtained by attaching a first chamber to a second chamber, wherein the first chamber contains the liquid color composition and the second chamber contains the liquid catalyst composition Preferably, for a device in which the perforatable seal is perforated, the perforation of the perforatable seal occurs during the attaching of the first chamber to the second chamber.

In another preferred embodiment, a method for altering the color of hair or skin is provided, comprising: (a) providing a device as described above, (b) intermixing the liquid color composition and the liquid catalyst composition to form the color altering composition; and (c) applying the color altering composition to hair or skin in an amount effective to alter color. Preferably, the color altering composition is applied to the skin or hair for a period of time in the range of from about 2 minutes to about 10 minutes. Preferably, the color altering composition comprises a plant extract and the hair is eyelashes or eyebrows. Preferably, the color altering composition alters the color of the eyelashes or eyebrows for a period of at least about 4 weeks.

Preferably, for a method that uses a device in which the seal is a perforatable seal attached to the enclosure and positioned between the liquid color composition and the liquid catalyst composition so as to prevent mixing when the perforatable seal is not perforated and to allow mixing to form the color altering composition when the perforatable seal is perforated, and in which the perforatable seal is not perforated at the time when the device is provided, the method further comprises perforating the perforatable seal prior to the intermixing. Preferably, the perforating is carried out with an applicator. Preferably, the intermixing is carried out by agitating with the applicator, or by sealing the opening with a cap after perforating the perforatable seal and intermixing by shaking the device.

In another preferred embodiment, a method for altering the color of eyelashes is provided, comprising providing a device as described above in which the seal is a perforatable seal attached to the enclosure and positioned between the liquid color composition and the liquid catalyst composition so as to prevent mixing when the perforatable seal is not perforated and to allow mixing to form the color altering composition when the perforatable seal is perforated, and which further comprises an applicator suitable for applying the color altering composition to the hair or skin, and sized to allow at least a portion of the applicator to pass through the opening, and in which the color altering composition comprises a plant extract and is suitable for altering the color of eyelashes or eyebrows, and in which the applicator is suitable for applying the color altering composition to the eyelashes or eyebrows, the method further comprising intermixing the liquid color composition and the liquid catalyst composition to form the color altering composition; and applying the color altering composition to the eyelashes in an amount effective to alter the color of the eyelashes for a period of at least about 4 weeks.

These and other embodiments are described in greater detail below.

BRIEF DESCRIPTION OF THE DRAWINGS

These and other aspects of the invention will be readily apparent from the following description and from the appended drawings (not to scale), which are meant to illustrate and not to limit the invention, and wherein:

FIG. 1 illustrates a preferred device for altering the color of hair or skin, showing a enclosure 110 that holds the components of the color altering composition, and an applicator 150;

DETAILED DESCRIPTION OF THE PREFERRED EMBODIMENTS

Figure 2:
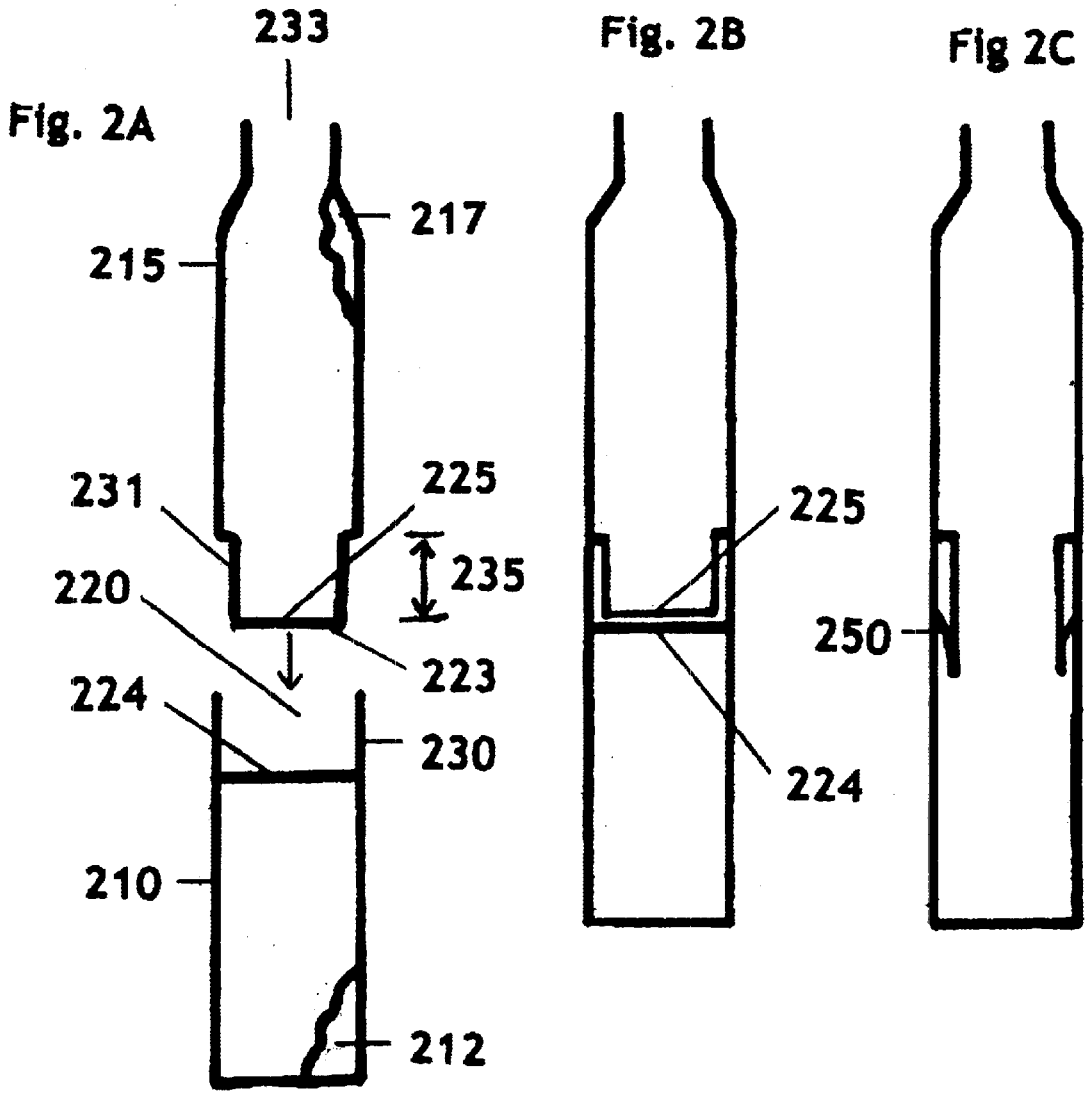
FIG. 2 is a cross sectional schematic diagram illustrating the assembly of a preferred embodiment of the enclosure.

The devices described herein are useful for altering the color of hair or skin. The term "altering the color of hair or skin" refers to the application of one or more color altering compositions to the hair or skin for the purpose of changing the color of the hair or skin to which the composition is applied, typically for cosmetic purposes.

Color altering compositions useful in the devices and methods described herein are typically prepared by intermixing two components, referred to herein as the "liquid color composition" and the "liquid catalyst composition," and known in the art as the "color" and "catalyst," respectively. By intermixing the components, the catalyst activates the color so that the resulting color altering composition, when applied to skin or hair, alters the color of the hair to a degree that persists for a period of days or weeks. The resulting color alteration of the treated skin or hair is relatively resistant to washing with ordinary soap and water, and is thus valued by the user because the coloring process can be performed less frequently. Preferably, the color altering compositions useful in the devices and methods described herein alter the color of the hair or skin to which they are applied for a period of at least about 4 weeks, more preferably about 4 weeks to about 6 weeks.

The principal components of the color altering composition, e.g., the liquid color composition and the liquid catalyst composition, are widely available from various commercial sources, typically in kit form, e.g., Revlon Professional Roux® Lash and Brow Tint. Preferably, the color altering composition produces relatively minimal irritation to the skin and eyes, more preferably is derived from organic sources, and most preferably comprises a plant extract. An example of a preferred kit containing a liquid color composition and a liquid catalyst composition is the Lash and Brow Tint kit available commercially from E-Z Permanent Make-up of Post Falls, Id. The supplier of the liquid color composition and the liquid catalyst composition typically provides the user with instructions regarding suitable amounts of each component to be used to obtain the desired coloring effect, and various formulations are available depending on the color desired, e.g., brown, blue/black, etc. Preferably, the liquid color composition and a liquid catalyst composition are creams. Similar products that contain additional additives or components are also useful in the devices and methods described herein.

The devices described herein preferably comprise an enclosure in which the components of the color altering composition, e.g., the liquid color composition and the liquid catalyst composition, are contained in a liquid storage reservoir within the enclosure. To prevent the liquid color composition and the liquid catalyst composition from being mixed with one another prematurely, the enclosure also comprises a seal that is positioned between the liquid color composition and the liquid catalyst composition so as to prevent substantial mixing of the liquid color composition and the liquid catalyst composition. The seal is adapted to permit the mixing the liquid color composition and the liquid catalyst composition at a desired time. For example, the seal may be removed from the enclosure so as to allow mixing, rotated so as to allow mixing or, in preferred embodiment, perforated to allow mixing. It will be appreciated that any type of seal which prevents substantial mixing until desired may be utilized. At any given time, the perforatable seal is either perforated or not perforated.

In the preferred embodiments, the seal is perforatable. When the perforatable seal has not been perforated, it is positioned between the liquid color composition and the liquid catalyst composition so as to prevent mixing. When perforated, it is positioned to allow mixing of the liquid color composition and the liquid catalyst composition to form the color altering composition. The enclosure further comprises an opening, for the purpose of allowing the color altering composition to be removed and applied to the hair or skin.

A preferred embodiment illustrating various preferred features of the devices described herein is illustrated in the drawing shown in FIG. 1. In this embodiment, a generally cylindrical enclosure 110 comprises a liquid storage reservoir 115. The liquid storage reservoir 115 is sized to contain a suitable quantity of liquid color composition at one end 120, and a suitable quantity of liquid catalyst composition at the other end 125. For clarity, small quantities of the liquids are shown in FIG. 1, but larger quantities may be present. A perforatable seal 130 is attached to the interior walls of the enclosure 110 between the end 120 and the opposite end 125, and thus is positioned between the liquid color composition and the liquid catalyst composition so as to prevent mixing when the perforatable seal 130 is not perforated.

The enclosure 110 further comprises an opening 135 (see FIG. 1B) and a narrower neck 140 integral to the enclosure and surrounding the opening. A cap 145 (see FIG. 1A) covers the opening 135 and prevents leakage of the liquids prior to use. Optionally, a second perforatable seal (not shown in FIG. 1) may be attached to the enclosure in a manner similar to the perforatable seal, but closer to the end 125, to prevent leakage of the liquids. The device also preferably comprises an applicator 150 having a lid 152, a wand 155 and a brush 157. The applicator 150 is sized to allow a portion thereof, e.g., the wand 155 and the brush 157, to pass through the opening 135 after the cap 145 is removed. In this embodiment, the perforatable seal 130 is perforated by pushing the wand 155 and the brush 157 portions of the applicator 150 through the opening as illustrated in FIG. 1B. The applicator 150 may then be moved back and forth within the enclosure 110 to intermix the liquid color composition and the liquid catalyst composition to form a color altering composition, and then used to apply the color altering composition to the hair or skin in the usual manner (not shown in FIG. 1).

The enclosure is preferably transparent or translucent so that the user can observe the mixing process. The enclosure is preferably made from a relatively rigid material such as plastic, and may be made in a single part by known processes such as by injection molding, or by assembly of smaller constituent parts. Preferably, the enclosure has a generally cylindrical shape with a circular cross section, but other shapes and cross sections, e.g., elliptical, rectangular, triangular, etc., may be suitable. The liquid reservoir within the enclosure can have the same general shape as the exterior, but is preferably round to achieve better integrity of the perforatable seal. The enclosure also has an opening, typically at one end, that allows the color altering composition to be removed. Optionally, the device may comprise a cap that can be sealingly attached to the opening. The cap may take the form of a disposable seal, such as the types of plastic/foil seals commonly used to seal bottles of over-the-counter medications, or the cap can be snapped or screwed onto the enclosure, e.g., in a manner known in the art. The cap may also form part of the applicator as shown in FIG. 1, or as shown in FIG. 3 (discussed below).

One purpose of the perforatable seal is to substantially prevent intermixing of the liquid color composition and the liquid catalyst composition when it is not perforated, and thus it is preferably made of thin, relatively impermeable materials. The perforatable seal preferably comprises one or more thin layers, the one or more layers preferably comprising a material selected from the group consisting of plastic, metal, and paper. The perforatable seal also preferably comprises an adhesive that secures the edges to the interior of the enclosure, although other attachment methods such as heat sealing may also be used. Another purpose of the perforatable seal is to allow mixing when desired by the user, and thus the term "perforatable" refers to a seal that is relatively easy to puncture using small amounts of force, e.g., by perforating the seal using an applicator as illustrated in FIG. 1. Several seals may be placed along the length of the liquid reservoir, and thus three or more liquids may be kept from intermixing within the enclosure, and/or a seal can optionally be placed at the far end of the liquid reservoir, as discussed above with respect to FIG. 1, in addition to or in place of a cap. The perforatable seal is preferably opaque, so that the user can observe whether it is perforated or not when the enclosure is clear or translucent, as is preferred.

For an enclosure such as that illustrated in FIG. 1, assembly may be accomplished by adding one component, e.g., the liquid color composition, to the enclosure, then inserting the perforatable seal through the opening and attaching it to the interior walls of the enclosure, then adding the second component, e.g., the liquid catalyst composition, then inserting and attaching a second seal (or placing a cap on the opening) to prevent leakage of the second component. Each of these assembly steps may be accomplished by methods known in the manufacturing art. For example, the perforatable seal may be attached using the manufacturing technology developed for such purposes, which is similar to that commonly used to seal bottles of over-the-counter consumer medications with plastic/foil seals. Likewise, methods for reproducibly adding relatively small quantities of liquids to small enclosures are well known in the art of manufacturing cosmetic products and over-the-counter liquid cold formulations.

The applicator is preferably sized to allow at least a portion of the applicator to pass through the opening, and more preferably has a length that is sufficient to perforate the perforatable seal and intermix the liquid color composition and the liquid catalyst composition to form the color altering composition. Suitable applicators and methods for making them are known in the cosmetics industries. FIG. 1 illustrates a preferred applicator, having a wand 155, a bush 157 and a portion 152 that is sized to be held with the fingers. Preferably, as illustrated in FIG. 1, the portion 152 also functions as a cap, and therefore may comprise threads (not shown in FIG. 1) for screwing the portion 152 onto the enclosure. The brush portion is preferably sized to permit convenient application of the color altering composition to the hair or skin, and may vary in configuration and type depending on the application, e.g., eyelashes, eyebrows, eyeliner, etc., as is known in the art. Preferably, the brush is relatively robust, so that it can be used to perforate the perforatable seal without being damaged. The applicator is preferably made from relatively rigid materials such as plastic.

In a preferred embodiment, the enclosure is obtained by attaching a first chamber to a second chamber, where the first chamber contains the liquid color composition and the second chamber contains the liquid catalyst composition. FIG. 2 is a cross sectional schematic diagram illustrating preferred methods for attaching the chambers to one another to form such an enclosure, although it is understood that the invention is not limited to the illustrated embodiments. FIG. 2A shows a first chamber 210 (containing one of the components, e.g. the liquid color composition 212) and a second chamber 215 (containing another component, e.g. the liquid catalyst composition 217). For clarity, small quantities of the liquids are shown in FIG. 2, but larger quantities may be present. Each of the chambers has an opening 220 and 223, but to prevent the liquids from leaking, each of the chambers also contains a perforatable seal 224 and 225 that is positioned between the liquid and the opening. The first chamber 210 further comprises a sleeve portion 230, and the second chamber 215 has a neck portion 231 that is sized to fit within the sleeve portion 230. Various lengths 235 may be selected for the neck portion 231. The second chamber 215 also contains an opening 233 (the chamber 210 could also contain such an opening, instead of or in addition to the opening 233 in the second chamber 215). To prevent leakage of the liquid 217, a cap (not shown) may be placed over the opening 233, in the general manner described above with respect to FIG. 1.

Assembly to form the enclosure 240 shown in FIG. 2B involves inserting neck portion 231 into sleeve portion 230 as shown by the arrow in FIG. 2A. The chambers 210 and 215 preferably lock together to form the enclosure 240, and thus the neck portion 231 may contain external threads (not shown) that match to internal threads (not shown) on the sleeve portion 230, or the chambers 210 and 215 may simply snap together by way of ridges and corresponding grooves on each of the chambers (not shown). The attachment method is not critical and other attachment methods may also be used. The length 235 of the of the neck portion 231 may be selected so that the perforatable seal 224 is not perforated, as shown in FIG. 2B, or so that the perforation of the perforatable seal 224 occurs during the attaching of the first chamber to the second chamber, as shown in FIG. 2C. If the perforatable seal 225 is removed or perforated prior to assembly, the perforated perforatable seal 250 shown in FIG. 2C allows intermixing of the liquids 212 and 217 (not shown). If the perforatable seal 225 is not removed or perforated prior to assembly, it may be perforated (along with the perforatable seal 224 if not already perforated, see FIG. 2B) prior to use by inserting an applicator through the opening 233, in the general manner described above with respect to FIG. 1. Embodiments such as that illustrated in FIG. 2 allow mixing and matching of the chambers 210 and 215, providing advantageous flexibility in manufacturing and use.

A preferred embodiment provides a method for altering the color of skin or hair, comprising providing a device as described herein, intermixing the liquid color composition and the liquid catalyst composition to form the color altering composition, and applying the color altering composition to hair or skin in an amount effective to alter color. If the perforatable seal is not perforated at the time the device is provided, e.g. as show in FIG. 1 or FIG. 2B, the method further comprises perforating the perforatable seal prior to intermixing. If the perforatable seal is perforated at the time the device is provided, e.g., during assembly as shown in FIG. 2C, perforation is not necessary, unless a second perforatable seal is also present. Perforation is conveniently accomplished using the applicator, as described above, although other objects such as toothpicks or Q-tips® may also be used.

Intermixing may be carried out in various ways. For example, intermixing can be carried out by agitating with the applicator, or the opening can be sealed with a cap after perforating the perforatable seal, and the intermixing accomplished by shaking the device. Other methods of intermixing may also be used.

The color altering composition is preferably applied to the skin or hair in a manner generally known to those skilled in the art of applying such products. The color altering composition can be applied by a professional cosmetologist, but the convenient nature of the devices described allows the user to apply the product to herself or himself, without the necessity of visiting a salon. The color altering composition is preferably organically derived from vegetables and/or plants, and more preferably comprises a plant extract, thus reducing potential irritation to the eyes and skin. The color altering composition is preferably applied to the skin or hair for a period of time in the range of from about 2 minutes to about 10 minutes, although longer or shorter periods may occasionally be desirable to obtain the desired coloring effect. The color altering composition is preferably applied to the eyelashes and eyebrows, and can also be applied to the cranial hair and to the skin, e.g., as an eyeliner. Excess product can be removed by methods known in the art, preferably by using soap and water or commercially available removal wipes. Preferably, the color altering composition alters the color of the eyelashes or eyebrows for a period of at least about 4 weeks, more preferably about 4 to about 6 weeks.

The devices and methods provided herein preferably provide a number of advantageous features. For example, the devices are convenient and can be inexpensive because a visit to a salon is not required. The user need not schedule the application in advance, and may do so in the privacy of the home. The use of organically derived components to minimize eye irritation also allows for easier application. The use of the devices avoids messy mixing procedures, and the self-contained nature of the product allows for easy disposal, features also likely to be appreciated by the professional cosmetologist.

In a preferred embodiment, the device 300 comprises an integral applicator and enclosure as illustrated in FIG. 3. In this embodiment, the clear or translucent enclosure 310 contains two perforatable seals 312 and 314, attached to and spaced along the length of the enclosure 310 and positioned to substantially prevent intermixing of the liquid color composition 320 and the liquid catalyst composition 325. For clarity, small quantities of the liquids are shown in FIG. 3, but larger quantities may be present. A portion 327 of the enclosure 310 is detachable from the rest of the enclosure, as explained below. The applicator 330 is in slidable contact with a sleeve 340, and the sleeve 340 is, in turn, in slidable contact with the interior face of the opening 350 at the end of the enclosure. The applicator further comprises a brush 335.

Figures 3A, 3B, 3C, 3D:
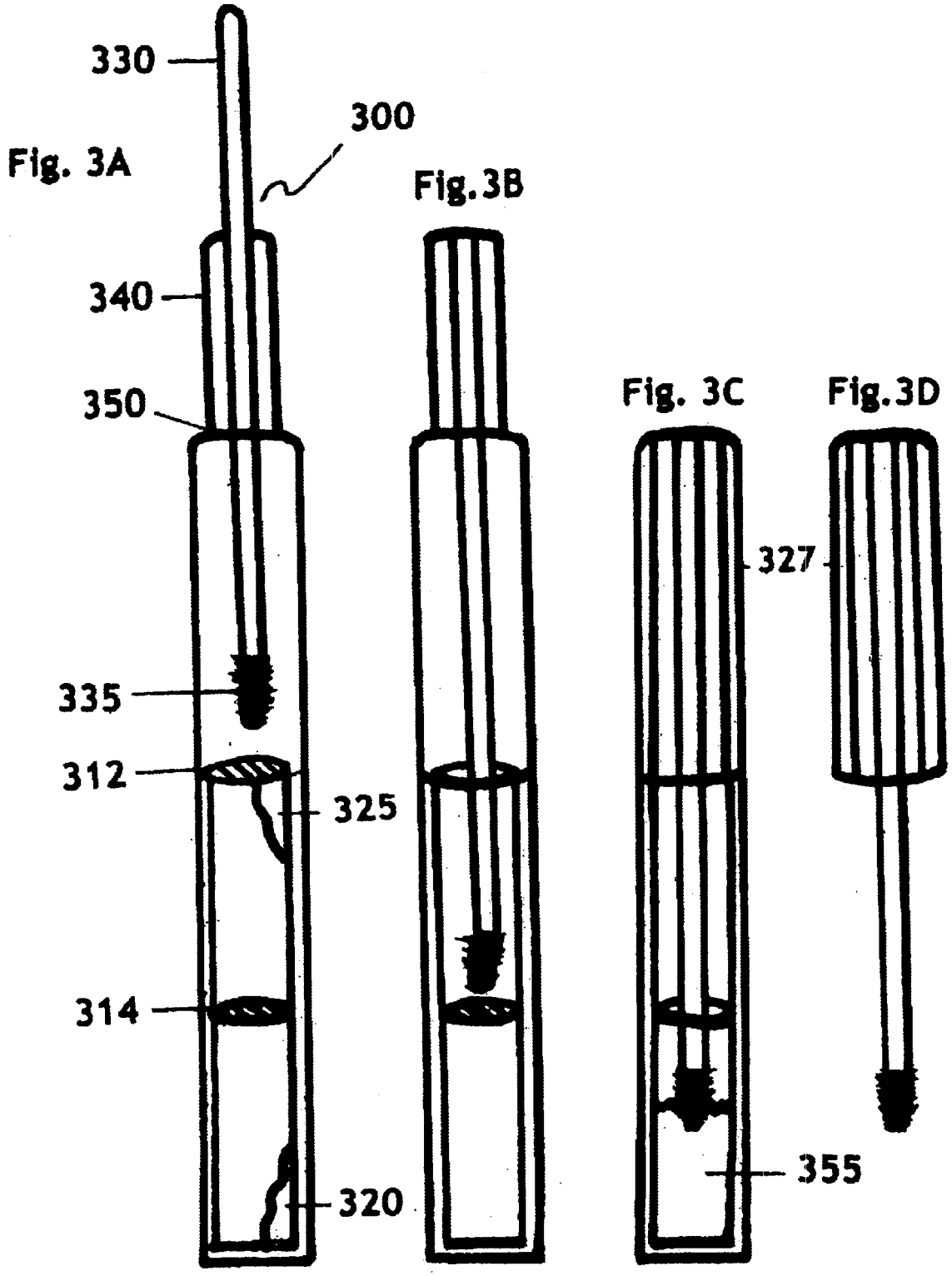
FIG. 3 illustrates a preferred device having an integral enclosure and applicator.

The device 300 is used by pushing the applicator 330 through the perforatable seals 312 and 314 as shown in FIGS. 3B and 3C, thus allowing the liquid color composition 320 and the liquid catalyst composition 325 to intermix and form a color altering composition 355. Detachment of the detachable portion 327 allows the applicator to be withdrawn and used to apply the color altering composition to the skin or hair as generally described elsewhere herein. The detachable portion 327 is preferably sized to be easily grasped by the fingers.

It will be appreciated by those skilled in the art that various omissions, additions and modifications may be made to the processes described above without departing from the scope of the invention, and all such modifications and changes are intended to fall within the scope of the invention, as defined by the appended claims.

What is claimed is:

1. A device for altering the color of eyelashes or eyebrows comprising:

(a) an enclosure comprising an opening and a liquid storage reservoir, wherein the liquid storage reservoir contains a liquid color composition and a liquid catalyst composition;

(b) a seal positioned between the liquid color composition and the liquid catalyst composition, the seal being adapted to prevent mixing of the liquid color composition and the liquid catalyst composition when such mixing is not desired, and to allow mixing between the liquid color composition and the liquid catalyst composition to form a color altering composition when such mixing is desired;

wherein the seal is a perforatable seal attached to the enclosure and positioned between the liquid color composition and the liquid catalyst composition so as to prevent mixing when the perforatable seal is not perforated and to allow mixing to form the color altering composition when the perforatable seal is perforated and a second perforatable seal positioned to prevent the liquid color composition and the liquid catalyst composition from passing through the opening.

2. The device of claim 1, further comprising a cap sealingly attached to the opening.

3. The device of claim 1, wherein the enclosure is clear or translucent.

4. The device of claim 1, wherein the liquid color composition is a cream and wherein the liquid catalyst composition is a cream.

5. The device of claim 1, wherein the perforatable seal comprises one or more layers, the one or more layers comprising a material selected from the group consisting of plastic, metal, and paper.

6. The device of claim 1, further comprising an applicator sized to allow at least a portion of the applicator to pass through the opening.

7. The device of claim 6, wherein the applicator comprises a wand and a brush, and wherein the applicator is suitable for perforating the perforatable seal.

8. The device of claim 6, wherein the color altering composition comprises a plant extract and is suitable for altering the color of eyelashes or eyebrows, and wherein the applicator is suitable for applying the color altering composition to the eyelashes or eyebrows.

9. The device of claim 8, wherein the color altering composition is suitable for altering the color of the eyelashes or eyebrows for a period of at least about 4 weeks.

10. The device of claim 1, wherein the enclosure is obtained by attaching a first chamber to a second chamber, wherein the first chamber contains the liquid color composition and the second chamber contains the liquid catalyst composition.

11. The device of claim 10, in which the perforatable seal is perforated, and wherein the perforation of the perforatable seal occurs during the attaching of the first chamber to the second chamber.

* * * * *